US005104681A

United States Patent [19]

Sansone

[11] Patent Number: 5,104,681

[45] Date of Patent: Apr. 14, 1992

[54] METHOD AND APPARATUS FOR MARKING LETTER MAIL

[75] Inventor: Ronald P. Sansone, Weston, Conn.

[73] Assignee: Pitney Bowes Inc., Stamford, Conn.

[21] Appl. No.: 459,417

[22] Filed: Jan. 2, 1990

[51] Int. Cl.[5] ..... B05D 5/00; B05C 11/00

[52] U.S. Cl. ..... 427/8; 427/285; 118/669; 118/712; 209/3.3; 209/584

[58] Field of Search ..... 427/8, 285; 118/669, 118/679, 713, 712; 209/3.3, 584; 235/456, 462, 487

[56] References Cited

U.S. PATENT DOCUMENTS

| | | | |
|---|---|---|---|
| 1,714,349 | 5/1929 | Dahlke . | |
| 2,709,001 | 5/1955 | Stahl . | |
| 2,890,825 | 6/1959 | Patrick . | |
| 3,015,438 | 1/1962 | Knight . | |
| 3,016,141 | 1/1962 | Lucas . | |
| 3,557,949 | 1/1971 | Washington | 209/584 X |
| 3,774,758 | 11/1973 | Sternberg | 235/487 X |
| 4,127,194 | 11/1978 | Erikson | 118/694 X |
| 4,167,476 | 9/1979 | Jackson | 209/3.3 |
| 4,201,617 | 5/1980 | Orsinger et al. | 118/712 X |

*Primary Examiner*—Evan Lawrence

*Attorney, Agent, or Firm*—Peter Vrahotes; Melvin J. Scolnick; David E. Pitchenik

[57] ABSTRACT

This invention relates to methods and apparatus for marking letter mail or mail pieces to provide a fast and convenient way of determining zip code breaks in a stack of letter mail. The mail pieces have marks printed on the edges thereof indicative of the continuity of the same zip codes thereon. The marks are visible when the mail pieces are stacked. Adjacent envelopes with the same zip codes will have an edge mark at the same location, but upon the zip code changing, the next envelope will have a mark placed at a different location. Numbers in sequence can be printed on each of the letters so that a mail clerk can inspect the last letter within a zip code group to determine if there is a sufficient number of mail pieces within that zip code set to allow a postal discount.

In an alternative embodiment, the markings on the side of the mail pieces are printed in a pattern so as to form numbers when a stack is viewed from the side. In addition to forming numbers, a pattern line can extend between the numbers. This allows a postal clerk to look at a stack of envelopes in a tray and from the side markings not only determine which of these envelopes are in the same zip code set, but also there would be an indication of the last number of the zip code.

20 Claims, 2 Drawing Sheets

METHOD AND APPARATUS FOR MARKING LETTER MAIL

BACKGROUND OF THE INVENTION

Initially, the processing of mail involved a mailer dropping letters, or mail pieces, into a mailbox, having the post office pick up the mail from the mailbox, transporting the mail to a post office and dispatching the mail to its ultimate destination, whether this destination be local or out of town. As time progressed, large mailers would deliver the mail directly to the post office where the mail would be inspected, sorted and forwarded. The post office found that if the mailers were given postal discount rates for performing certain acts, such as the presorting of mail, bundling the mail, and the like, a great deal of time would be saved by the post office. As a result of such discounting, large mailers were encouraged to preprocess their mail and mail processing equipment such as scales, inserters, folders, and the like were developed to assist the mailer in his mailing operations. As a further development of streamlining mail processing, permit mail was created whereby the mailer was not required to place postage upon each mail piece, but rather was able to send the mail pieces to the post office in batch form. A statement sheet, such as a postal form 3602, would accompany the mail so that an accounting could be made for postage required for the mail.

Although what is outlined above worked fairly well for a period, the increase in amount of mail being processed by the post office became so large that the post office began experiencing delays in processing the mail. Presently, as much as 160 billion pieces of mail per day are being handled by the post office annually. This is placing a heavy burden on the post office with an attendant delay in the delivery of mail, as well as loss of postage due to inefficiencies in accounting due to the sheer volume.

As a result of the above problem, postal authorities held discussions with mailers and mail equipment manufacturers for the purpose of developing schemes that would be useful to the post office and allow the post office to process mail more quickly, efficiently and economically. As a result of these discussions, certain worksharing routines have been proposed whereby the mailer and certain mailing agents would perform tasks that would assist the post office in the processing and the delivery of mail. As an example, batch letter mail sent to the post office would be certified either by the mailer, or by a postal agent, whereby the certification of the mail assured the post office that the called for quantity of mail was accurate and that the postage being paid to the post office was sufficient. Another scheme involved certifying the deliverability of the mail. These schemes, and others like them, are still in the evaluation stage. Although these schemes have addressed many problems, there is one problem that is still in need of attention. This problem relates to the need of a postal clerk to make a fast determination with regard to the zip codes of stacked mail pieces and whether the number of mail pieces within a given zip code are sufficiently large in number for a postal discount.

SUMMARY OF THE INVENTION

This invention relates to a method and apparatus for marking letter mail to provide a fast and convenient way of determining zip code breaks in a stack of letter mail. The envelopes have marks printed on the edges thereof indicative of the continuity of the same zip codes printed on the mail pieces. The marks are visible when the envelopes are stacked. Adjacent envelopes with the same zip codes will have an edge mark at the same location, but upon the zip code changing, the next envelope will have a mark placed at a different location. In this manner, a clerk can sight those envelopes that are to be delivered to the same zip code.

In addition to having a mark placed on the letter mail edge, numbers in sequence can be printed on each of the letters so that the mail clerk can inspect the last letter within a zip code group to determine if there are a sufficient number of mail pieces within that zip code set to allow a mailer a postal discount.

In an alternative embodiment, the markings on the side of the envelopes can be printed in a pattern so as to form numbers when a stack is viewed from the side. In addition to forming numbers, a pattern line can extend between the numbers. This allows a postal clerk to look at a stack of envelopes in a tray and from the side markings he can not only determine which of these envelopes are in the same zip code set, but also there would be an indication of the last number of the zip code.

DETAILED DESCRIPTION OF THE PREFERRED EMBODIMENTS

Figure 1:
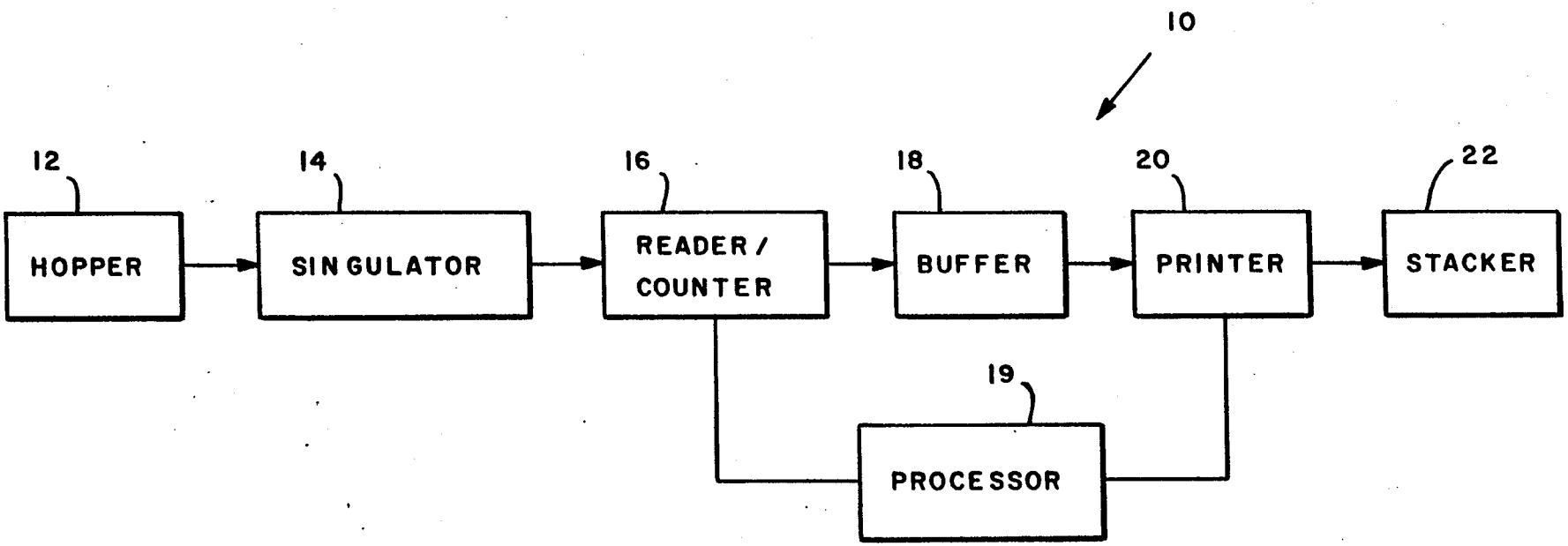
FIG. 1 is a block diagram showing a system for carrying out the instant invention.

Referring now to FIG. 1. A system is shown in block diagram form for carrying out the invention. It will be appreciated that the invention can be carried out using one of a large number of systems and equipment as part of the system. The block diagram is for illustrative purposes to indicate to one skilled in the art a specific example of how one may carry out the invention.

A hopper 12 is provided that would hold a large number of mail pieces. The mail pieces are contemplated as being envelopes 24 with windows 26 having inserts 28 therein to form mail pieces, see FIGS. 2A and 2B. The envelopes, of course, would normally be sealed. The hopper 12 contains a plurality of stacked mail pieces which can be fed by any convenient method to a singulator 14. The singulator 14 simply would be equipment that feeds mail pieces one at a time from the hopper 12. Downstream from the singulator 14 is a reader/counter 16 that reads the zip code on the insert 28 of the mail piece and a counter that would count the number of mail pieces that have the same zip code. A buffer 18 is provided between the reader/counter 16 and a printer 20. The printer 20 is in communication with the reader/counter 16 and functions to print marks and numbers on the mail pieces in a fashion that will be described hereinafter. As shown, a processor 19 is located between the reader/counter 16 and printer 20 but this processor could be located in either of these units. After the marks and numbers have been printed on the mail pieces, the mail piece is placed into a stacker 22 where the mail pieces are stacked as for example in a tray. Although a mail piece with a windowed envelope has been used as an example, it will be appreciated that non windowed envelopes with the zip code printed on the face of the envelope can be used as well.

Figure 2A:
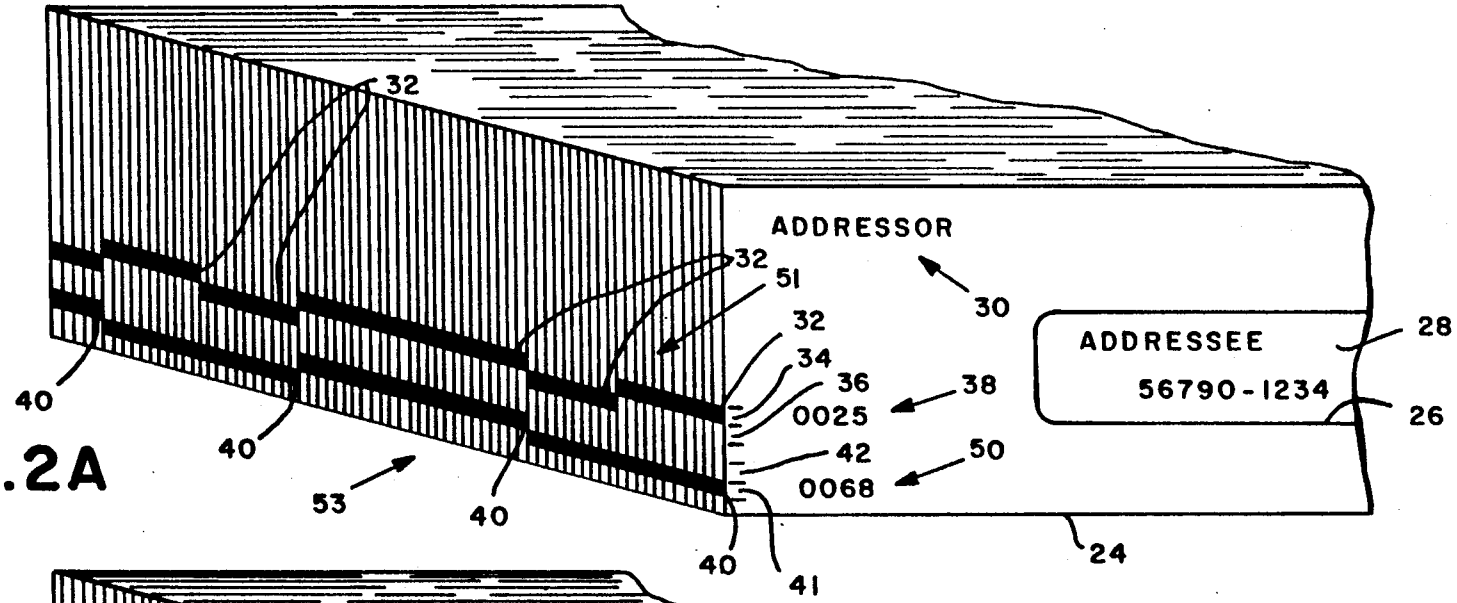
FIGS. 2A and 2B show stacks of envelopes with markings in accordance with the embodiments of the instant invention.

With reference now to FIG. 2A, the envelope 24 has a window 26 therein through which inserts 28 are visible. The insert 28 will have the name of the addressee and the zip code thereon. In the upper left hand corner of the envelope 24 is the address 30 of the sender of the mail. Printed on the side of the mail piece is a first mark 32 that has two positions, 34,36. Adjacent to this mark 32 is a number 38. Also located on the edge of the envelope 24 is a second mark 40 that also has two locations 41,42 on the edge of the envelope. Another number 50 is located adjacent the second mark 40. The marks 32,40 will be visible when the mail pieces are stacked as shown in FIG. 2A. When a mail piece has a zip code, in this case a five digit zip code, it will be read by the reader/counter 16 and a mark placed or printed by the printer 20 in one of two locations 34,36 on the edge under the control of the processor 19. Because of the communication between the reader/counter 16 and the printer 20, the printer can determine when a zip code has been changed in cooperation with the processor 19. As seen by the facing mail piece in FIG. 2A, the mark 32 is placed in the first location 34. If the next mail piece has the same zip code as the first mail piece, a mark will be placed at the same location as the first mail piece and this will continue until there is a change in the zip code. When the zip code changes, the mark 32 will then be placed in the second position 36, as can be seen at 51. This will continue in this same location until there is another change in the zip code of the mail pieces at which time the mark will then be placed at the first position 34 once more. This scheme will continue for all the mail pieces stacked by the stacker 32.

As will be noted, there are two marks on the mail pieces 24 shown in 2A. The upper mark 32 indicates the change in five digits of the zip code. The zip code given is 56789. If there is any change, particularly in the last two figures, this will be indicated by changing the location of the mark. For example, if the zip code changes from 56789 to 56790, the mark would go from the first location 34 to the second location 36. By the same token, if the zip code changes from 56789 to 45678, again there will be a change in location. The second mark 40 is a three zip code number change, the three numbers being the first three numbers of the zip code. Once more, what is shown is 56789. Upon the zip code changing from 56789 to 56790, the mark 40 would not change its position because the first three digits of the zip code have not changed. On the other hand, upon the zip code changing from 56789 to 45678, then the mark 40 would change its location as seen at 53. Clearly, the upper mark 32 will change its location more frequently than the lower mark 40 since the former will change upon any one of the five digits changing, and the mark 32 will change locations every time the mark 40 changes locations. The value of having two marks 32,40 to show the change in three digits and five digits of a zip code is that the postal clerk can not only determine the number of mail pieces within a five digit zip code, but he can also determine when the three number zip changes. This frequently implies a change in destination. For example, the three zip 069 would indicate that the mail is going to Connecticut, whereas the zip 342 would indicate the mail is going to Florida. It will be appreciated that the marks 32, 40 and their locations are not only human readable but machine readable as well so as to provide automatic traying. Further, having the marks 32, 40 machine readable allows automatic banding into sets of zip codes.

Figure 2B:
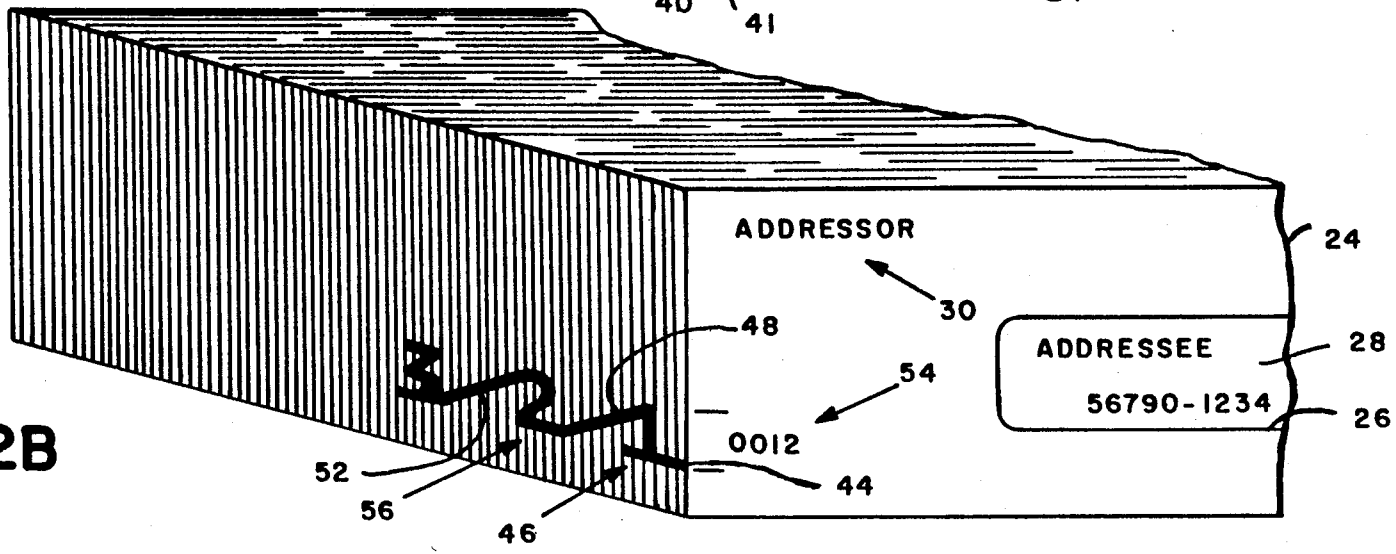

With reference to FIG. 2B, a second embodiment is given of the invention. In this embodiment the marks 44 are printed in such a manner as to form numbers 46 on the edge of the mail pieces after they are stacked and viewed from the side. In addition, a diagonal line 48 extends from the first number 46 to the second number 50. The first number would indicate a first group and the number may represent the last number of the five digit zip code. The diagonal line 48 represents the continuum of the same zip code within that set of mail pieces with the same zip code. With the second number 50 being shown, this indicates that the zip code has changed and this pattern will continue throughout the stack. In addition, a number 54 is printed in the lower left hand corner of the envelope 24 to indicate the number of mail pieces with the same zip code.

Thus, what has been show and described in a scheme for providing rapid identification of sequenced mail pieces having the same zip code and/or having partially the same zip code.

What is claimed is:

1. A method of indicating in a stack of mail pieces having zip codes printed thereon the change of zip code from one mail piece to an adjacent mail piece of the stack, the steps comprising:

providing a series of mail pieces having respective zip codes located thereon, placing a mark at a first location on an edge of one of said mail pieces having a first zip code thereon, continuing to place a mark at said first location on subsequent sequential mail pieces having said first zip code, and placing a mark at a second location on said one edge of another mail piece upon said another mail piece having a second zip code and upon all subsequential mail pieces having said second zip code.

2. The method of claim 1 further including the step of placing numbers in sequence adjacent to said marks to indicate the number of the mail pieces in sequence having the same zip code.

3. The method of claim 1 further including placing a mark at said first location upon a subsequent mail piece having a third zip code and upon all subsequent sequential mail pieces having such said third zip code.

4. A method of indicating in a stack of mail pieces having zip codes printed thereon, the change of zip code from one mail piece to an adjacent mail piece of the stack, the steps comprising:

providing a series of mail pieces having respective zip codes located thereon, placing a mark at a first location on an edge of a first of said mail pieces, continuing to place said mark at said first location on subsequent sequential mail pieces having the same first three digits of it respective zip code, placing a mark at a second location on one edge of a mail piece upon that mail piece having a change in the first three digits of its zip code from its preceding mail piece in the series;

placing a mark at a third location on an edge of said first of said mail pieces, and continuing to place a mark at said third location as long as the last two digits of said zip code on subsequent sequential mail pieces remain the same, and placing a mark at a fourth location on one edge of a mail piece upon that mail piece having a change in the last two digits of its zip code from its proceeding mail piece.

5. The method of claim 1 further including the step of placing numbers in sequence adjacent to the marks at least one of said locations to indicate the number on the envelope in sequence having the same three digits of its zip code.

6. The method of claim 4 further including the step of placing numbers in sequence adjacent to at least one of the marks to indicate the number of the envelope in sequence having the same last two digits of its zip code.

7. The method of claim 4 further including placing a mark at said first location upon a subsequent mail piece having a second change in the first three digits of its zip code.

8. The method of claim 4 further including placing a mark at said third location upon a subsequent mail piece having a second change in the last two digits of its zip code.

9. A method of indicating in a stack of mail pieces having zip codes printed thereon the change of zip code from one mail piece to an adjacent mail piece of the stack, the steps comprising:

providing a plurality of mail pieces having respective zip codes located thereon, placing a mark at a first location on a first edge of a first mail piece, continuing to place a mark at said first location on subsequent adjacent mail pieces having the same zip code as said first mail piece, and placing a mark at a second location on one edge of a subsequent mail piece upon that subsequent mail piece having a different zip code.

10. The method of claim 9 further including the step of placing numbers in sequence adjacent to the marks to indicate the number of the envelope in sequence having the same zip code.

11. A method of indicating in a stock of mail pieces having zip codes printed thereon the change of zip code from one mail piece to an adjacent mail piece of the stack, the steps comprising:

assemblying a plurality of sets of mail pieces with the mail pieces of each set having the same zip code located thereon, placing a mark at a first location on a first edge of a first of said mail pieces, continuing to place a mark on one edge of each subsequent mail piece having the same zip code in a manner to form a number when said set of mail pieces is stacked, and placing a mark on the edge of each mail piece of a second set of mail pieces having a different zip code to form a second number when said second set of mail pieces is stacked.

12. The method of claim 11 further including the step of placing numbers in sequence adjacent to the marks to indicate the number of the envelopes in sequence having the same zip code.

13. The method of claim 11 further including placing the marks on the edges of the mail pieces to form a continuous line between the numbers formed by the edges.

14. An apparatus for indicating in a stack of mail pieces having zip codes printed thereon the change of zip code from one mail piece to an adjacent mail piece is the stack, comprising:

means for providing a plurality of mail pieces having respective zip codes located thereon, means for placing a mark at a first location on a first edge of mail pieces of a first set having a first zip code thereon and means for placing a mark at a second location on the edges of a subsequent set of mail pieces having the same zip code but a different zip code from the first set of mail pieces.

15. The apparatus of claim 14 further means for placing numbers in sequence adjacent to the marks to indicate the number of the mail pieces in sequence having the same zip code.

16. An apparatus for indicating in a stack of mail pieces having zip codes printed thereon the change of zip code from one mail piece to an adjacent mail piece if the stack, comprising:

means for assembling a plurality of sets of mail pieces, the mail pieces of each set having the same zip code located thereon, means for placing a mark on one edge of each mail piece of a first set having the same zip code thereon in a manner to form a number when said set of mail pieces is stacked, and means for placing a mark on the edge of each mail piece of said second set of mail pieces to form a second number on said second set of mail pieces when the second set of mail pieces is stacked.

17. The apparatus of claim 16 further including means for placing marks of the edges of an envelope in a set so as to form a continuous line between said first number and said second number.

18. The apparatus of claim 17 further wherein said continuous line a diagonal line.

19. The apparatus of claim 16 further including means for printing a number on the face of mail piece indicating its number in sequence of a set of mail pieces having the same zip code.

20. An apparatus for indicating the zip code of sets of mail pieces of a stack of mail having a zip code printed on each mail piece, the combination comprising:

means for placing a mark at a first edge location on mail pieces of a first set of mail pieces having the same first zip code, and means for placing a mark at a second edge location on mail pieces of a second set of mail pieces having the same second zip code.

* * * * *